US006463605B2

(12) United States Patent
Swagger, Jr.

(10) Patent No.: US 6,463,605 B2
(45) Date of Patent: Oct. 15, 2002

(54) BEACH MAT

(76) Inventor: David L. Swagger, Jr., 1456 Deer Crossing La., Worthington, OH (US) 43085

( * ) Notice: Subject to any disclaimer, the term of this patent is extended or adjusted under 35 U.S.C. 154(b) by 0 days.

(21) Appl. No.: 09/755,363

(22) Filed: Jan. 5, 2001

(65) Prior Publication Data

US 2002/0088053 A1 Jul. 11, 2002

(51) Int. Cl.[7] ..... A47G 9/06
(52) U.S. Cl. ..... 5/420; 40/584
(58) Field of Search ..... 5/417–420; D6/608; 40/584

(56) References Cited

U.S. PATENT DOCUMENTS

| | | | | | |
|---|---|---|---|---|---|
| 4,709,430 | A | | 12/1987 | Nicoll | 5/417 |
| 5,035,013 | A | * | 7/1991 | Bloom | 5/420 |
| 5,103,514 | A | * | 4/1992 | Leach | 5/420 |
| 5,117,517 | A | * | 6/1992 | Su | 5/420 |
| 5,206,964 | A | | 5/1993 | Wilson, Sr. | 5/417 |
| 5,394,575 | A | | 3/1995 | Wolter et al. | 5/419 |
| 5,435,024 | A | | 7/1995 | Capshaw | 5/417 |
| 5,572,758 | A | * | 11/1996 | Merritt | 5/420 |
| D391,797 | S | * | 3/1998 | Vuori | D6/608 |
| 5,843,556 | A | * | 12/1998 | Levas | 5/420 |
| 6,122,780 | A | * | 9/2000 | Taylor | 5/417 |
| 6,199,230 | B1 | * | 3/2001 | Parikh | 5/420 |

FOREIGN PATENT DOCUMENTS

| | | | |
|---|---|---|---|
| GB | 2698 | * of 1903 | 5/490 |

OTHER PUBLICATIONS

"Paulownia Wood Mattress Pad" A pamphlet of Morisaki–K–Gri Co Ltd, dated May 5, 1988 –5/420.*

* cited by examiner

*Primary Examiner*—Alexander Grosz
(74) *Attorney, Agent, or Firm*—David A. Greenlee

(57) ABSTRACT

A beach mat for maintaining a beach towel in a flat deployed position provides a barrier to the movement of sand onto the towel surface and comprises spaced side members interconnected at their ends by spaced end members and having an inner periphery defining a generally rectangular central opening. In one embodiment, the frame is filled with self-inflating resilient foam and has an air valve for allowing expulsion of air during compaction of the frame and maintenance of the frame in compacted condition for transportation and storage. In another embodiment the foam frame is folded for transportation and storage. Handles and a cup holder are provided. The frame provides a large upper surface for placement of advertising or other indicia for display.

4 Claims, 2 Drawing Sheets

BEACH MAT

TECHNICAL FIELD

This invention relates to a device for securing a beach towel against wind dislodgement, and more particularly, to a beach mat which includes a beach towel that is mounted to preclude wind dislodgement and ingress of sand onto the towel surface.

BACKGROUND OF THE INVENTION

People who visit a beach invariably take a beach towel, lay it on the sand, and use it for resting or sunbathing and as a barrier to skin contact with the sand. It is quite difficult to maintain the towel in a flat condition because, invariably, beaches are inherently windy, and the wind will dislodge a corner or an edge and the towel will fold over upon itself or wrinkle. This reduces the viability of the towel as a platform for lying upon, since this movement of the towel is usually accompanied by the deposit of sand on the towel surface. Not only is it then too narrow, but also too contaminated by sand to serve its intended function.

Since the main reason for using a towel is to shield the towel user from sand, the towel must then be picked up and shaken to remove the sand. This must be done carefully, for it is poor etiquette to sandblast other nearby sunbathers with the removed sand propelled by the wind.

Numerous solutions to this ages old problem have been proposed. Most involve placing a weight on all four corners of the beach towel. This is of limited utility, since the edges are still subject to the whims of the wind. Also, people walking by often unintentionally dislodge one of the weights and the towel flaps away. An attempt to cure this shortcoming is shown in U.S. Pat. No. 5,245,715, which provides tent stakes attached to clips that grip the towel corners. Unfortunately, the connecting cord could well trip passersby.

Other solutions include of replacing the towel with a rattan mat. However these mats are uncomfortable, since they cannot conform to the body contours. They are similar to lying on a floor. U.S. Pat. No. 5,394,575 discloses a foam rubber mat that is inherently more flexible. Such a mat will become uncomfortably hot in the sun.

Another solution provided in U.S. Pat. No. 4,634,618 is to sew weights into the border of a towel. This is effective in keeping the towel flat, but doesn't address the problem of passersby inadvertently kicking sand onto the towel surface.

U.S. Pat. No. 4,709,430 discloses a hollow tube frame which is sewn into a special double thickness towel. This tube is then filled with water to make it heavy enough to prevent wind dislodgement. The tube provides a raised edge as a barrier to movement of sand onto the towel surface. This arrangement is unwieldy and requires use of an expensive special towel.

In U.S. Pat. No. 5,206,964, a special towel is attached to itself around an inflatable tube to provide a weighted frame and sand barrier. However, it must be blown or pumped up and is subject to being punctured, making it useless.

There is need for a simple, effective and inexpensive device which prevents wind dislodgement, which provides a barrier to the deposition of sand on the towel surface, and which is easy to transport and store.

Most beaches are public and, as such, ban advertising. Heretofore, advertisers have been forced to use airplane-towed banners to advertise their products to beachgoers, or to provide cups, towels and t-shirts with their advertising on it. None of these are truly effective, since airplane-towed banners are expensive, towels are often crumpled or folded, t-shirts are often not worn at the beach, and cups and the like are too small.

Thus, there is a need for a stable platform of sufficient size to enable advertisers to advertise their products legally at the beach.

SUMMARY OF THE INVENTION

It is therefore an object of this invention to provide a simple, effective and inexpensive device which prevents wind dislodgement, which provides a barrier to the deposition of sand on the towel surface, and which is easy to transport and store.

It is another object to provide a beach mat having a frame for a beach towel that secludes the towel surface from intrusion of sand and maintains the towel securely in a flat position to enhance sunbathing.

It is a further object to provide a lightweight beach mat that provides a towel frame that has sufficient flat surface to serve as an advertising platform to provide advertisers of products interesting to beachgoers a means of legally advertising at the beach.

In one aspect this invention features a beach mat having a towel frame for maintaining a beach towel in a flat deployed position and providing a barrier to the movement of sand onto the towel surface. The frame comprises spaced side members interconnected at their ends by spaced end members and has an inner periphery defining a generally rectangular central opening. A first fastening means is mounted on the frame inner periphery for engaging second fastening means mounted on the towel to secure the towel to the frame to cover the central opening and maintain the towel securely in a flat position. This secludes the towel surface from the intrusion of sand, thereby enhancing use by sunbathers.

In another aspect of this invention, the first fastening means are strips of hook material, and the second fastening means are loop material, forming a hook and loop fastener to secure the towel to the frame. In yet another aspect of this invention, the fastening means are snaps.

In a preferred form, a beach mat having a lightweight foam beach towel peripheral frame is provided that is an air cell and has a valve that enables squeezing of the frame to compress the frame by expelling air to reduce the size of the frame, and is closable to maintain the frame in the compressed condition for storage and/or transportation.

Preferably, the air cell is filled with resilient cellular foam and is normally expanded and filled with air in, but can be manually compressed to compact the beach mat for transportation and storage. The frame is normally rolled and fastened in rolled condition and includes handles for ease of transportation. Preferably, the frame mounts a hard plastic footboard, which has a circular depression to confine the bottom of a beverage can or bottle, and which facilitates rolling and compression of the foam.

In another form, the frame includes a pair of sub-frames which are identical U-shaped members, each including one of the end members and spaced legs each forming a portion of the side members, with the towel interconnecting the sub-frames, thus enabling the frame to be folded in half.

In another embodiment, the sub-frame legs are hinged together to enable the frame to be folded in half twice, reducing the size of the frame to one-fourth its deployed size to facilitate transportation and storage.

Preferably, in both forms, the frame includes an inner peripheral inset for mounting the fasteners.

These and other objects and features will become more readily apparent upon reference to the following detailed description of this invention, as illustrated in the attached drawings, in which:

DETAILED DESCRIPTION THE PREFERRED EMBODIMENT

Figures 1, 2, 3, 4, 8:
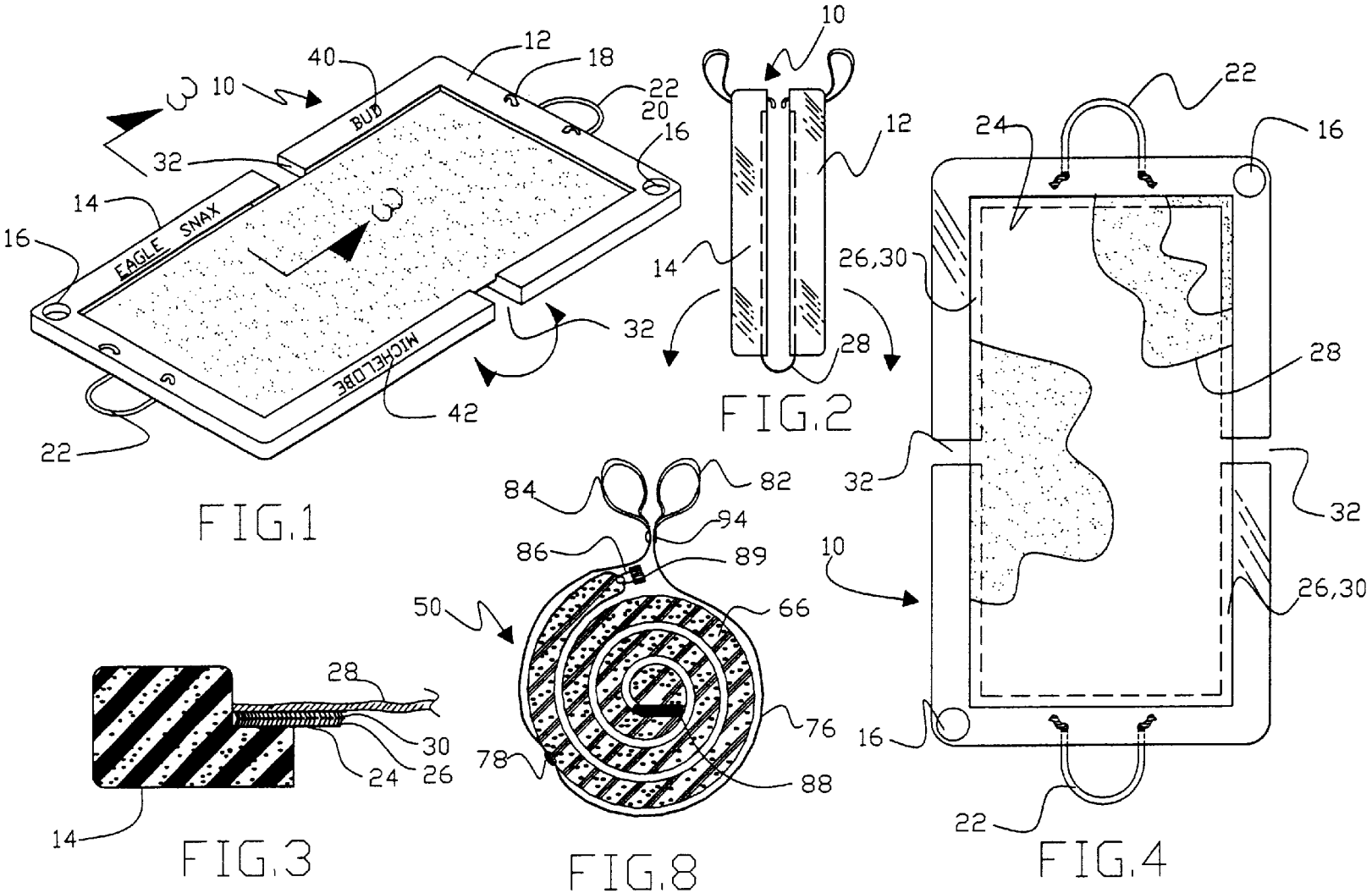
FIG. 1 is perspective view of one embodiment of beach frame of this invention, illustrating its use as an advertising platform.
FIG. 2 is an end view of the frame of FIG. 1, with the towel installed and the frame folded for transportation.
FIG. 3 is an enlarged sectional view, taken along line 3—3 of FIG. 1.
FIG. 4 is a plan view of the frame with towel installed.
FIG. 8 is a sectional view of the frame of FIGS. 5–7, shown in deflated condition, ready for transportation or storage.

A first embodiment of this invention is illustrated in FIGS. 1–4, where a beach towel frame comprises a pair of identical U-shaped foam frame members 12, 14, which are made of a self-skinned or vinyl coated closed cell foam material. Each of the members 12, 14 includes a circular recess 16 for holding a cup, bottle or can. Holes 18, 20 are provided through the ends of members 12, 14 for receiving a length of nylon rope, which is knotted at its ends and serves as a handle 22.

Both frame members include a recessed ledge 24 that mounts a strip of hook material. 26. The dimensions of frame 10 and ledge 24 are such that a standard-size beach towel 28 fits within frame 10. Towel 28 carries a peripheral strip of loop material 30 that forms a hook-and-loop fastener with hook strip 26 to secure towel 28 to frame 10.

When towel 28 is secured to frame 10 by interengagement of strips 26 and 30, frame members 12, 14 are spaced by a gap 32 at either side. This gap 32 provides sufficient slack in towel to enable folding if frame 10 to the FIG. 2 position for transport. When frame 10 is folded as in FIG. 2, the handles are in registry for ease of gripping by a hand to transport or carry the frame to or from the beach.

The frame members 12, 14 of frame 10 are held together by towel 28. This avoids the use of additional fasteners or straps to secure frame together, thus simplifying the structure. Towel 28 can easily be replaced by merely peeling it off frame 10 to separate the hook-and loop strips 26, 30.

After development of the FIGS. 1–4 embodiment, this inventor developed a preferred embodiment of beach towel frame according to this invention, which is illustrated in FIGS. 5–8.

Figure 5:
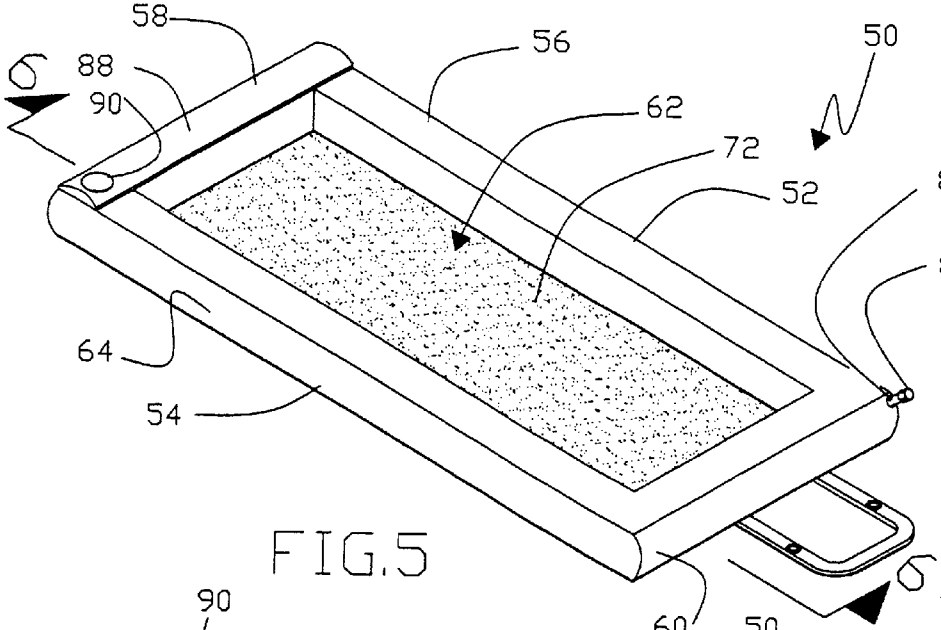
FIG. 5 is a perspective view of another embodiment of beach towel frame of this invention.
Figure 6:
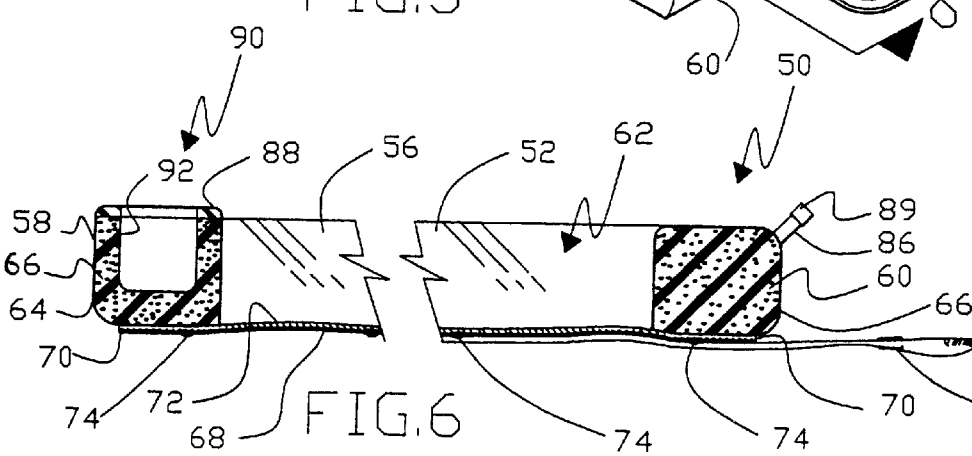
FIG. 6 is an enlarged sectional view, taken along line 6—6 of FIG. 5.

Referring now to FIGS. 5 and 6, a beach mat 50 is a hollow rectangular peripheral frame 52 comprising spaced side members 54 and 56 connected at their ends by end members 58 and 60, defining a central opening 62. Frame 52 has a water- and air-impermeable covering 64, such as treated canvas or other fabric, or plastic, which encapsulates a cellular, resilient foam material core 66. A bottom sheet 68, also of water-impermeable fabric or plastic, is sewn or otherwise attached to the bottom periphery of covering 64, such as illustrated at 70.

Figure 7:
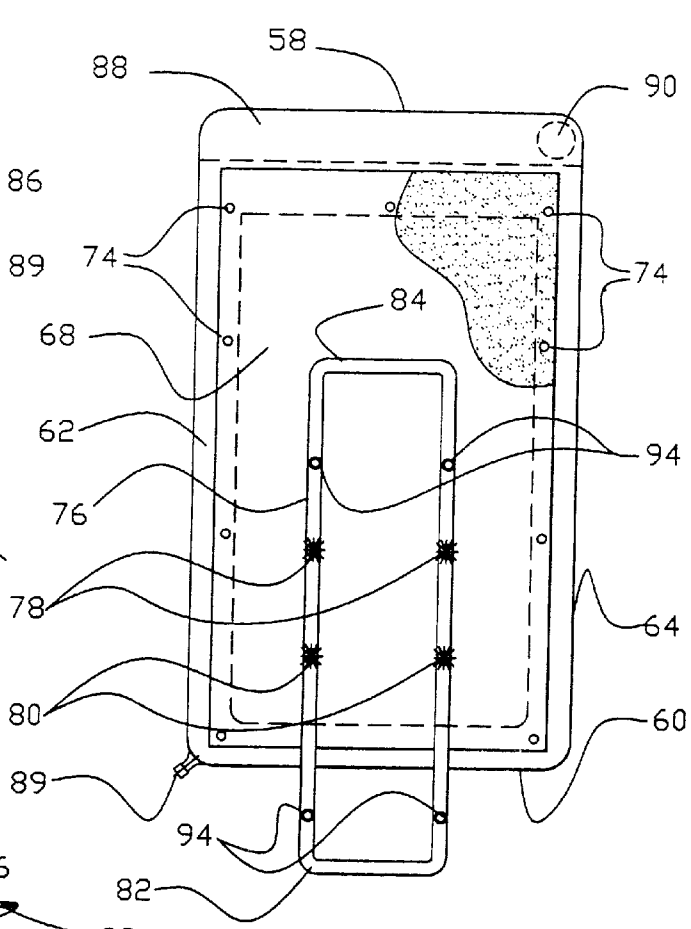
FIG. 7 is a bottom view of the beach towel frame of FIG. 5.

A rectangular terry towel 72, is secured atop the bottom sheet 68 by a plurality of spaced peripheral snap fasteners 74, which underlie frame side and end members 54, 56, 58 and 60. As shown in FIG. 7, an elongated loop of strap material 76, such as cotton or nylon, is sewn, or otherwise attached to the bottom of bottom sheet 68 at 78 and 80 to form two elongated loops 82 and 84

A hard plastic footboard 88 is mounted atop end member 58 and includes a circular opening 90 which communicates with a fabric-lined cylindrical depression 92 in end member 58, to provide a beverage can or bottle holder. One comer of frame 52 mounts an air valve 86 which communicates with foam 66 inside frame 52 and is selectively closed by a cap 89 to provide an airtight seal.

Beach mat 50 is Illustrated in its normal expanded use condition in FIGS. 5, 6, and 7. As shown in FIG. 6, foam material 66 is in its normal, fully air-filled condition, and cap 89 is secured on air valve 86, thus preventing intrusion of sand or water into foam material 66. A beachgoer may recline within opening 62 of frame 52, which provides a barrier to the intrusion of sand that may blown along the beach or be kicked up by passersby. Footboard 88 provides a footrest, while soft end member 60 provides a headrest, and cup holder 92 enables the beachgoer to rest a beverage container safely against spillage.

Because of its foam construction, beach mat 50 is lightweight, and an be easily moved along the beach when in its expanded use condition. However, it is sufficiently heavy to resist movement by normal wind action when unoccupied.

When use of beach mat 50 is no longer desired, it is easily collapsed into a compact condition for transportation and storage. Air valve cap 89 is removed, and footboard 88 is grasped and squeezed as it, along with end member 58, is rolled lengthwise to compress foam material 66. When the length of frame 52 has been rolled, cap 89 is screwed onto air valve 86 to preclude any ingress of air into foam material 66, so as to maintain it in the compressed condition, as illustrated in FIG. 8. Strap 76 is then looped around the rolled beach mat SO and secured by snaps or other fasteners 94 so that end loops 82 and 84 become handles for transporting the compressed beach mat 50, as illustrated.

Both embodiments of this invention provide a lightweight device for maintaining a beach towel in flat position, while protecting it from the casual ingress of beach sand. A beachgoer can readily lie within the frame with head and/or feet resting on the foam ends. Cup holders provide a stable holder for cups, bottles or cans of beverages, without fear of spilling.

The height and thickness of the frames 10, 110 can be varied, but a 6" wide, 2" thick section, with 1" insets has been found useful. The unbroken upper surfaces of the frame members is especially useful for displaying advertising slogans or logos or other indicia for display, such as shown at 40, 42 in FIG. 1. The fasteners for securing the towel to either embodiment of beach mat may be either hook-and-loop or snap fasteners. If snap fasteners are used, they should be plastic or stainless steel to prevent corrosion.

While only a preferred embodiments of this invention have been disclosed and described, many modifications will become readily apparent to those skilled in the art and are contemplated within the scope of this invention as defined by the following claims.

I claim:

1. A beach mat for use by a reclining beachgoer which maintains a beach towel in a flat deployed position and provides a barrier to the intrusion of sand onto the towel surface, comprising a frame having spaced side members interconnected at their ends by spaced end members and having an inner periphery defining a generally rectangular central opening, said frame comprising a water-impermeable and air-impermeable cover material encapsulating a resilient foam core that is collapsible upon compression, an air valve carried by the cover material and operable to selectively connect the foam core to the atmosphere, thus enabling compaction of the foam core to collapse the beach mat, and maintenance of the beach mat in collapsed condition for transportation and storage, first fastening means mounted on the frame inner periphery for engaging second fastening means mounted on the towel to secure the towel to the frame to cover the central opening and maintain the towel securely in a flat position and seclude the towel surface from the intrusion of sand, thereby enhancing use by sunbathers, and a bottom sheet secured to the bottom of the frame and mounting the towel thereupon, said first fastening means being mounted on the bottom of the frame above the bottom sheet to hide the fastening means beneath the frame side and end members and present a clean towel surface for engaging the body of a reclining beachgoer.

2. The beach mat of claim 1, wherein the frame is compressed by compacting the foam core. and one of the end members mounts a hard board on its upper surface to facilitate compaction of the foam core and rolling of the beach mat into a compact condition, and including means for securing the rolled beach mat in compact condition.

3. The beach mat of claim 2, including the securing means include straps attached to the bottom sheet for encircling the rolled beach mat, third fastening means on the straps to secure the rolled beach mat in rolled condition, and free loops extending from the third fastening means forming handles to transport the rolled beach mat.

4. The beach mat of claim 1, wherein said side members and end members have expansive flat upper surface areas forming an advertising platform, and advertising indicia located on said advertising platform, so as to be observable by said beachgoers when said beach towel frame is unfolded.

* * * * *